United States Patent [19]

Shaw et al.

[11] Patent Number: 4,933,667

[45] Date of Patent: Jun. 12, 1990

[54] GRAPHIC ANNUNCIATOR

[75] Inventors: Bon F. Shaw, Winter Park; Gary M. Bond, Orlando, both of Fla.

[73] Assignee: Fike Corporation, Blue Springs, Mo.

[21] Appl. No.: 248,822

[22] Filed: Sep. 23, 1988

[51] Int. Cl.[5] ..... G08B 25/00; G08B 5/00; 340 525; 340 506; 340 522; 340 531; 340 286.11; 455 600; 455 603

[52] U.S. Cl. ..... 340/525; 340/505; 340/522; 340/531; 340/286.11

[58] Field of Search ..... 340/525, 506, 522, 531, 340/286.11; 455/600, 603

[56] References Cited

U.S. PATENT DOCUMENTS

| | | | |
|---|---|---|---|
| 4,101,872 | 7/1978 | Pappas | 340/539 |
| 4,491,830 | 1/1985 | Miyabe | 340/531 |
| 4,524,354 | 6/1985 | Morgan | 340/525 |
| 4,536,747 | 8/1985 | Jensen | 340/522 |
| 4,538,138 | 8/1985 | Harvey et al. | 340/531 |
| 4,622,540 | 11/1986 | Guscott et al. | 340/506 |
| 4,737,770 | 4/1988 | Brunius et al. | 340/506 |

*Primary Examiner*—Donnie L. Crosland
*Attorney, Agent, or Firm*—Hovey, Williams, Timmons & Collins

[57] ABSTRACT

A versatile, economical, and structurally simple annunciator for use with a fire detection system or the like is provided which requires only a single connection with the detection system, which can be configured as desired, and which allows additional annunciators to be connected thereto. The preferred annunciator is particularly suited for use with a detection system producing data signals representative of abnormal conditions such as fire, unauthorized entry, or the like. The preferred annunciator includes a plurality of light-emitting diodes arranged in a graphic representation of the protected area and a signal processor coupled with the light-emitting diodes for receiving and processing the data signals and for selectively actuating the light-emitting diodes in response thereto according to configuration data stored in memory. The data signals are preferably optical signals transmitted over a fiber optical cable.

20 Claims, 7 Drawing Sheets

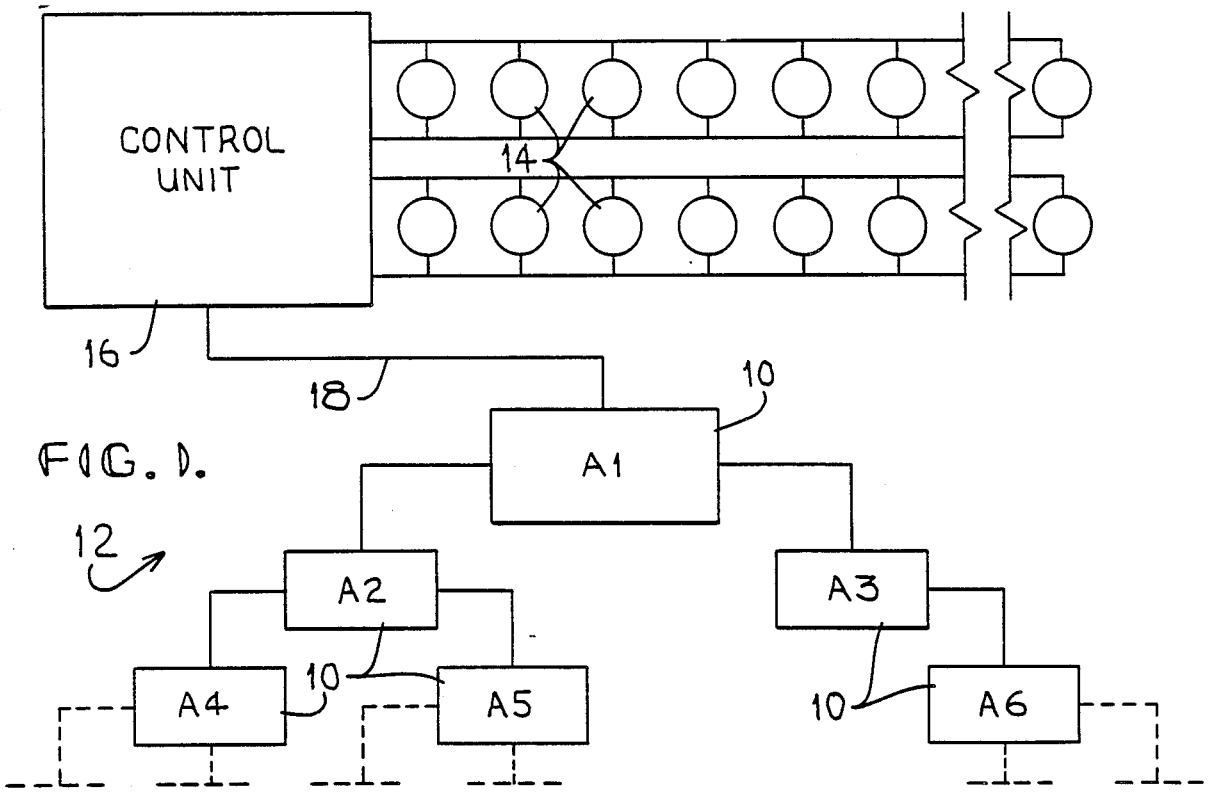
FIG. 1.
FIG. 2.
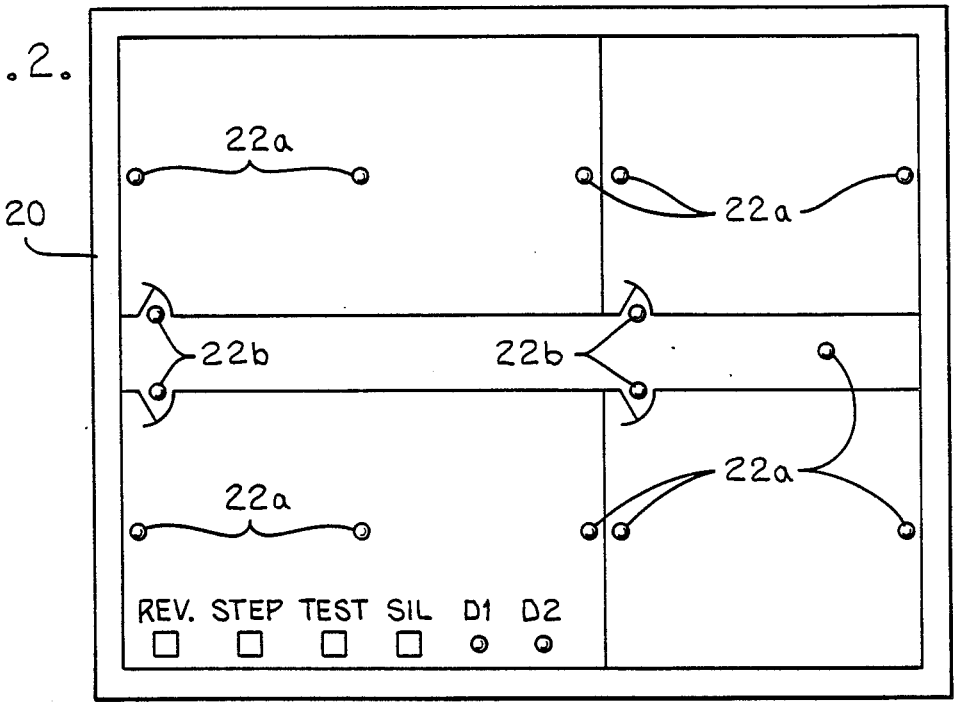

ANODE DRIVER
A1-8
A9-16
LATCH
CATHODE SINK
IN7 COM
OUT
STR
CLR
OE
C1-8
C9-16
NVRAM
EPROM
PGM
VPP
PSEN
ALE
RD
WR
μP
RESET
X1
X2
EA/VP
P1.4
P1.5
P1.6
P1.7
TXD
INTØ
RXD
P1.3
P1.2
P1.1
P1.0
P2.Ø-6
P0.Ø-7
SERIAL INTERFACE
T1 IN
T1 OUT
R1 IN
R1 OUT
PHONE JACK
11.06 MHZ.
TTL
VCC

GRAPHIC ANNUNCIATOR

BACKGROUND OF THE INVENTION

1. Field of the Invention

The present invention concerns an annunciator providing graphic representation of alarm conditions in response to data signals received from a fire detection system or the like. More particularly, the present invention is concerned with an annunciator operable for receiving the data signals as optical signals over a fiber optic cable, and for selectively actuating indicators arranged as a graphic display.

2. Description of the Prior Art

A typical fire protection system includes a plurality of detectors coupled with a central control panel. Upon detection of a fire or other abnormal condition by the detectors, the control panel activates fire extinguishing agents sound alarms, and so forth. Prior art annunciators for use with detection systems include a plurality of lamps or other indicators configured as a graphic representation of the area protected by the detection system and which are activated to illustrate the location of a fire. These prior art annunciators have required a wire connection to each detector in order to activate the corresponding indicator.

As those skilled in the art appreciate, prior art annunciators present a number of problems. For example, the cost of providing a wire connection to each detector can be substantial. Additionally, a short circuit in the connecting wire can cause detector failure. This failure potential has been a barrier to insurance carrier approval of annunciators in fire protection systems.

Known prior art systems have also been limited to one annunciator per system. This can be a disadvantage, for example, in a multi-floor installation where the presence of an annunciator on each floor would help in quickly locating the abnormal condition on that floor.

More recent detection systems use a central control panel which evaluates signals from associated detectors to determine whether an abnormal condition exists and which produces and sends signals representative of these abnormal conditions to an annunciator which processes the data signals and actuates appropriate indicators. These newer installations, however, do not allow multiple annunciators, for example, and tend to be electrically complex and thereby expensive.

SUMMARY OF THE INVENTION

The present invention solves the problems as outlined above. That is to say, the graphic annunciator hereof is versatile, reliable, and structurally simple for economy in manufacture.

Broadly speaking, the preferred graphic annunciator hereof includes a plurality of selectively actuatable indicators, and signal processing means coupled with the indicators and including means for coupling with a detection system for receiving and processing data signals therefrom representative of certain predetermined conditions and, in response, for actuating selected ones of the indicators.

In preferred forms, the annunciator includes means for coupling with the detection system in order to produce the data signals as optical signals and a fiber optic cable for intercoupling the detection system and the signal processing means for transmission of the optical signals.

The preferred signal processor includes means for retransmitting the incoming data signals over a transmission line for use by other annunciators, and further includes a memory device for storing configuration data representative of predetermined correspondence between the indicators and the predetermined conditions represented by the data signals. The preferred signal processor is also operable to actuate the indicators in order to provide a sequential review of past occurrences of the predetermined conditions.

The preferred indicators are light-emitting diodes activatable upon simultaneous receipt of two activation signals. The indicators are preferably coupled with the signal processor in a multiplex arrangement such that two activation signals are required to activate a respective indicator. Other preferred aspects are explained hereinbelow.

BRIEF DESCRIPTION OF THE DRAWING FIGURES

FIG. 1 is a schematic representation illustrating a plurality of annunciators of the present invention coupled in a branching arrangement and coupled for data signal reception with a detection system;

FIG. 2 is a front view of the preferred annunciator illustrating the indicators arranged in a graphic representation of an area being protected;

DETAILED DESCRIPTION OF THE PREFERRED EMBODIMENT

Figure 3:
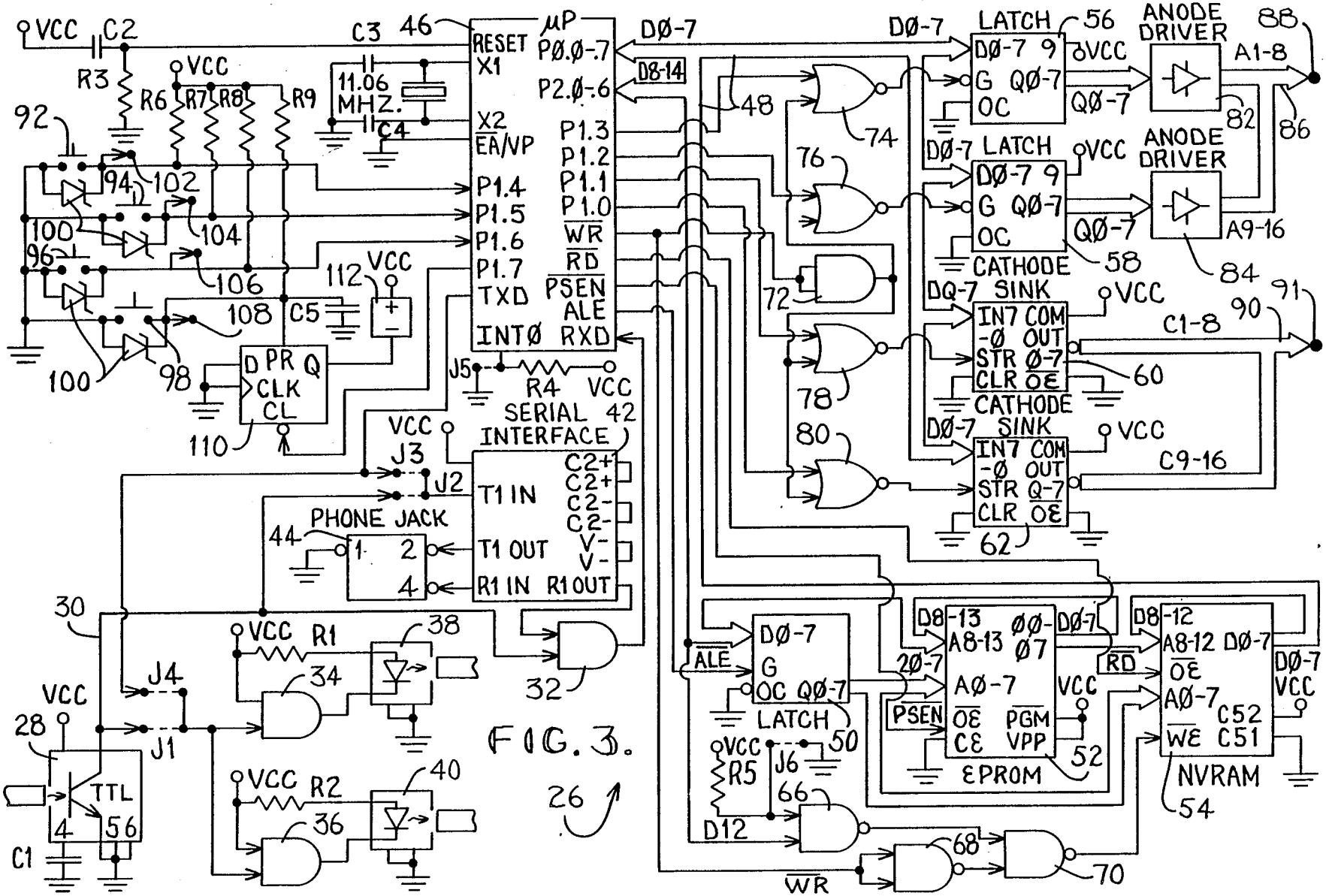
FIG. 3 is an electrical schematic diagram of the signal processor of the annunciator.

Graphic annunciator 10 is preferably used in connection with a detection system 12 for detecting fires, unauthorized intrusions and the like. In this context, detection system 12 includes a plurality of parallel connected detectors 14 coupled with control unit 16. Control unit 16 is operable to receive and process detector signals received from detectors 14 and to produce output data signals representative of predetermined conditions as sensed by detectors 14. The data signals are transmitted over transmission line 18 for reception by annunciator 10. FIG. 1 illustrates a plurality of annunciators 10 arranged in a branching configuration which is explained further hereinbelow.

Preferred annunciator 10 includes a housing having front panel 20 (FIG. 2), a plurality of indicators 22 included in indicator circuit 24 (FIG. 4), and signal processing circuit 26 (FIG. 3).

As shown in FIG. 2, front panel 12 is preferably a flat plate having artwork thereon graphically illustrating the area protected by detector system 12. FIG. 2 illustrates front panel 20 configured to represent a floor plan of a portion of a building protected by detector system 12 with indicators 22 placed through appropriately defined holes in panel 12. Indicators **22*a* represent the location of various detectors 14 or fire protection zones defined by a plurality of detectors 14, and indicators 22*b*** represent doorways. As those skilled in the art will appreciate, the artwork of front panel 12 can be configured as desired to represent the protected area.

FIG. 3 illustrates signal processing circuit 26 which receives the data signals transmitted over transmission line 18 from control unit 16. Circuit 16 processes the data signals to actuate indicators 22. In the preferred embodiment, the present invention provides for detector system 12 to produce the data signals as optical signals with transmission line 18 being a fiber optic cable for transmission of the optical data signals thereover. With this arrangement, no electrical connection is present between annunciator 10 and detection system 12 which avoids the potential of a short circuit in line 18 affecting the reliability of detection system 12. Additionally, transmission line 18, as a fiber optic cable, is effectively immune to external electromagnetic influences which can be a problem with a two wire pair, even if shielded. Finally, because no electrical connection exists between annunciator 10 and detection system 12, insurance carrier approval of detection system 12 is unaffected by the connection of annunciator 10.

Referring now to FIG. 3, signal processing circuit 26 includes a conventional power supply (not shown) for supplying operating power at +5 V.D.C. (Vcc) as converted from 120 V.A.C. It is also preferred that the power supply include battery back-up in the event of power failure.

Signal processing circuit 26 receives the optical data signals from optical fiber transmission line 18 at conventional optical receiver 28 (Part No. 92915-R-HS available from Thomas & Betts Corporation of Raritan, N.J.) with terminals 4, 5, and 6 thereof connected to ground, with terminal 4 connected to ground by way of capacitor C1 (0.1 uF), and with terminal 1 connected to Vcc. Receiver 28 converts the optical data signals to TTL signals for transmission via line 30 to jumper J1, jumper J2, and AND 32.

With jumper J1 in place, data signals are transmitted to AND 34 and AND 36 as input to respective, conventional, optical transmitters 38 and 40. The other inputs to AND gates 34, 36 are clamped to Vcc. Vcc also provides input power to transmitters 38 and 40 by way of resistors R1 and R2 (both 110 ohms) respectively.

Transmitters 38, 40 provide the ability to retransmit the data signals to other annunciators which can retransmit the data signals to even more annunciators as illustrated in FIG. 1. This provision is particularly advantageous when it is desired to provide an annunciator for each local section of the protected area. For example, in a shopping mall, annunciator A1 might graphically illustrate all of the stores and rooms in the shopping mall and be located centrally. With the retransmission capability, additional annunciators can be located in each store configured to illustrate only the protected areas thereof. With the annunciator located near the entrance to the store, the source of an abnormal condition, such as a fire, can be quickly pin-pointed. As explained further hereinbelow, the retransmission capability also allows a plurality of annunciators to be configured as one large annunciator in the event the number of desired indicators exceeds the capacity of any one annunciator.

With jumper J2 in place, the data signals from receiver 28 are transmitted top terminal T1 IN of serial interface 42 (type MAX233) for retransmission to terminal 2 of conventional phone jack 44. This allows remote reception and diagnostic monitoring of the data signals either by a microcomputer (such as an IBM personal computer) connected locally or remotely by way of telephone lines. Serial interface 42 is also operable to receive data at terminal R1 IN from terminal 4 of phone jack 44 for reconfiguring the system parameters as explained further hereinbelow.

Serial interface 42 receives input power at +5 V.D.C. as shown and includes a pair each of terminals C2+, C2−, and V− jumpered together as shown to produce internal voltage of + or (−) 10 V.D.C. for proper serial communication. Interface 42 also provides data output at terminal R1 OUT to AND 32. Terminal 1 of jack 44 is grounded as shown.

The output from AND 32 is connected for data signal input to terminal RXD of microprocessor 46 (type 8031) which transmits data out from terminal TXD to jumpers J3 and J4. Jumper J3 is optionally connected to serial interface terminal T1 IN and allows remote reading of the system configuration. Jumper J4 is optionally connected to AND gates 34, 36 and allows output data from microprocessor 46 to be transmitted by transmitters 38 and 40.

Terminal RESET of microprocessor 46 is connected to one side of resistor R3 (110K ohms), the other side of which is connected to ground, and to one side of capacitor C2 (10 uF), the other side of which is connected to Vcc. This configuration allows a reset pulse on power up.

Terminals X1 and X2 are respectively connected to one side of capacitors C3 and C4 (both 30 pF), the other sides of which are connected to ground, and to either side of crystal 48 selected to generate clock pulses at 11.06 megahertz. Terminal EA/VP is connected to ground as shown. Additionally, terminal INT0 is connected to one side of resistor R4 (110 ohms) and to jumper J5, the other side of which is connected to ground. As explained further hereinbelow, jumper J5 allows the program to skip unassigned indicators during the review and step function.

Data bus 48 interconnects microprocessor 46 with address latch 50 (type 74LS373), erasable, programmable, read-only-memory 52 (EPROM) (type 27128), non-volatile, random-access-memory (NVRAM) (type 6264), data latches 56 and 58 (both type 74LS373), and cathode sinks 60 and 62 (both type UCN5801A). The respective data lines and terminals connected thereto for each device 50–62 are conventional and shown in FIG. 3.

Microprocessor terminal ALE is connected to terminal G of latch 50, microprocessor terminal $\overline{PSEN}$ is connected to terminal $\overline{OE}$ of EPROM 52, and microprocessor read terminal $\overline{RD}$ is connected to terminal $\overline{OE}$ of NVRAM 54.

Address latch terminal OC is connected to ground. Latch 50 provides outputs L0–7 at terminals Q0–7 respectively which are connected to respective EPROM terminals A0–7 and NVRAM terminals A0–7.

EPROM terminal CE is connected to ground and terminals Vpp and $\overline{PGM}$ are connected to Vcc. EPROM 52 stores the operating program of microprocessor 46 as illustrated in the flowcharts of FIGS. 5–8.

NVRAM terminal $\overline{CS1}$ is connected to ground and terminal CS2 is connected to Vcc. The upper 4K bytes of NVRAM 54 contain the system configuration data and can be optionally write protected by the network connected to terminal $\overline{WE}$. The write protection network includes NAND gates 66, 68, and 70. One input of NAND 66 is provided by data line D12 from data bus 48. The other input is connected to one side of pull up resistor R5 (4.7K ohms), the other side of which is connected to Vcc, and to jumper J6, the other side of which is connected to ground.

Both inputs to NAND 68 are connected to microprocessor terminal $\overline{WR}$. The outputs from NAND gates 66, 68 supply the inputs to NAND 70 the output of which is connected to NVRAM terminal $\overline{WE}$. The upper 4K bytes of NVRAM 54 are write protected with jumper J6 removed and defeated when in place.

Microprocessor terminal $\overline{WR}$ is also connected to both inputs of AND 72 which acts as a signal conditioner. The output from AND 72 is connected to one input each of NOR gates 74, 76, 78, and 80. The other inputs NOR gates 74–80 are connected respectively to microprocessor terminals P1.3, P1.2, P1.1, and P1.0. The respective outputs from NOR gates 74–76 are connected to terminals G of data latches 56, 58. The respective outputs from NOR gates 78, 80 are connected respectively to strobe terminals STR of cathode sinks 60, 62.

Respective terminals OC of data latches 56, 58 are connected to ground as shown. The respective outputs from latches 56, 58 are produced at terminals Q0–Q7 respectively and transmitted to the respective inputs of anode drivers 82, 84 (both type UDN2985A). The outputs from anode drivers 82, 84 are produced on respective anode lines A1–8 and A9–16 making up anode bus 86 to output terminal 88 for connection to indicator circuit 24. Respective terminals 20 of latches 56, 58 are connected to Vcc.

Respective terminals CLR and OE of cathode sinks 60, 62 are connected to ground, and terminals COM are connected to Vcc. Cathode sinks 60, 62 provide outputs on lines C1–8 and C9–16 making up cathode bus 90 which terminates at output connector 91 for connection to indicator circuit 24. As explained further hereinbelow in connection with indicator circuit 24, the anode driver outputs and cathode sink outputs control up to 256 indicators 22 coupled in a multiplex configuration.

Signal processing circuit 26 also includes review switch 92, step switch 94, indicator test switch 96, and audible alarm silence switch 96. These switches are preferably manually actuated, normally open, membrane switches and are accessible for activation on front panel 20 as shown in FIG. 2.

Each switch 92–98 has a respective transient suppression device 100 connected across the terminals thereof, and one side of each switch 92–98 is connected to ground as shown in FIG. 3. The ground-opposed terminals of switches 92–96 are connected respectively to terminals 102, 104 and 110, to one side of resistors R6, R7, and R9 (4.7K ohms each), and to microprocessor terminals P1.4, P1.5, and P1.6. The ground-opposed side of switch 98 is connected to terminal 108, to one side of pull up resistor R9 (4.7K ohms), to one side of capacitor C5 (1 uF), the other side of which is connected to ground, and to terminal PR of beeper control flip-flop 110 (type 74LS74). The other sides of resistors R6–R9 are connected to Vcc.

As explained further hereinbelow, review and step switches 92, 94 are used to step through past alarm conditions in sequence with corresponding indicators 22 actuated in order to view the progress of a fire, for example. Lamp test switch 96 is used to actuate all of indicators 22, and silence switch 98 is used to silence the audible alarm.

Flip-flop terminal Q is connected to the negative terminal of audible beeper 112, the positive terminal of which is connected to Vcc. Data terminal D and clock terminal CLK of flip-flop 110 are connected to ground, and terminal CL is connected to microprocessor terminal P1.7. When terminal P1.7 goes low, flip-flop terminal Q goes low to sink current in order to actuate beeper 112. When silence switch 98 is depressed, the input to flip-flop terminal PR is grounded low and inverted to activate terminal Q high to silence beeper 112.

Figure 4:
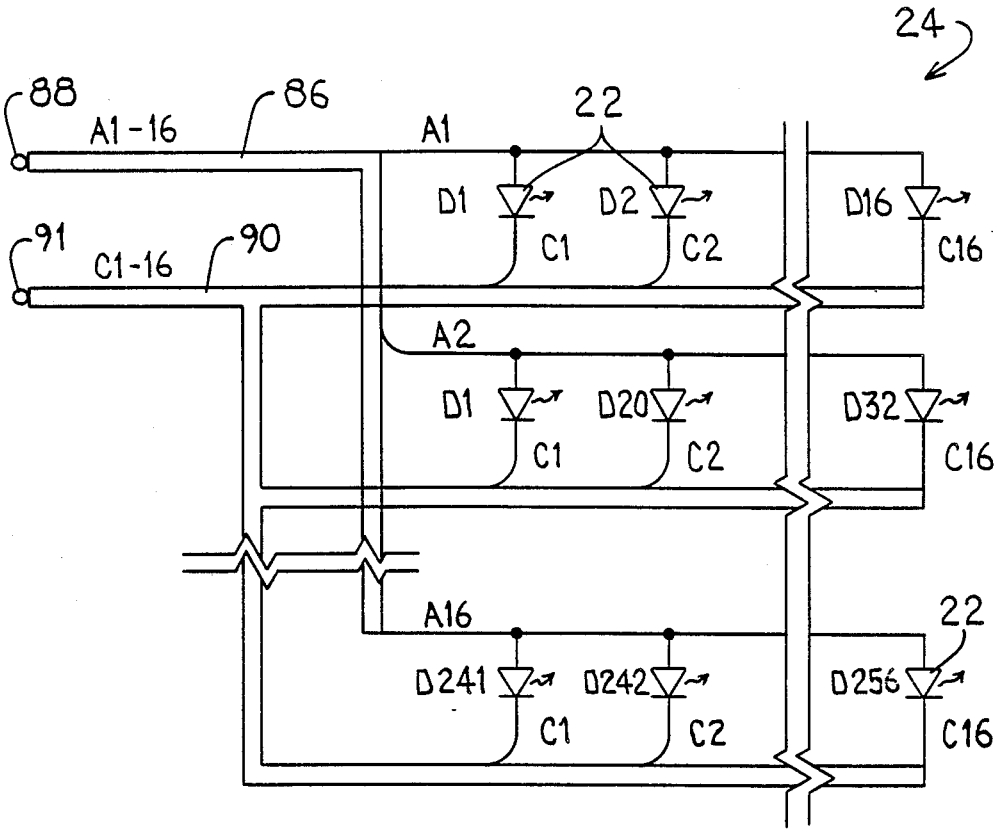
FIG. 4 is an electrical schematic diagram of the indicator circuit of the annunciator.

FIG. 4 illustrates indicator circuit 24 and the multiplex arrangement of indicators 22 which are preferably light-emitting diodes (LED's). Anode bus 86 enters indicator circuit 24 by way of connector 88 and cathode bus 90 enters by way of connector 92. As illustrated in FIG. 4, the provision of 16 anode lines A1–16 and 16 cathode lines C1–16 allow the connection of 256 separately controlled LED indicators 22 which are electrically grouped in 16 rows of 16 indicators each and designated D1 through D256.

Anode line A1 connects to the anode of LED indicators D1–D16. Cathode lines C1 through C16 respectively connect to the cathodes of LEDs D1–D16. Similarly, anode line A2 connects to the anodes of diodes D17–D32 with cathode lines C1–16 connected to the respective cathodes thereof. Anode lines A3 through A16 respectively couple with the anodes of each successive group of 16 LEDs and cathode lines C1–16 respectively couple with the cathodes of each group of 16 LEDs.

With this configuration, 256 possible combinations of active high anode lines and active low cathode lines are possible. Thus, LED D1 is activated to emit light when anode line A1 is active high and cathode line C1 is active low. Similarly, LED D2 is activated when anode line A1 is active high and cathode line C2 is active low, and so forth such that LED D256 is activated when anode line A16 is active high and cathode line C16 is active low. In this way, two output signals are required, an active high anode line and an active low cathode line, in order to activate a given LED. With this multiplex arrangement, the need for 256 separate wires is eliminated thereby contributing to the simplicity and low manufacturing cost of annunciator 10.

In operation, the activated LEDs are activated one at a time in sequence. The operation of microprocessor 46 and the operation of the program are rapid enough, however, that the illumination of an actuated LED appears to be substantially continuous to an oberver.

Figure 5:
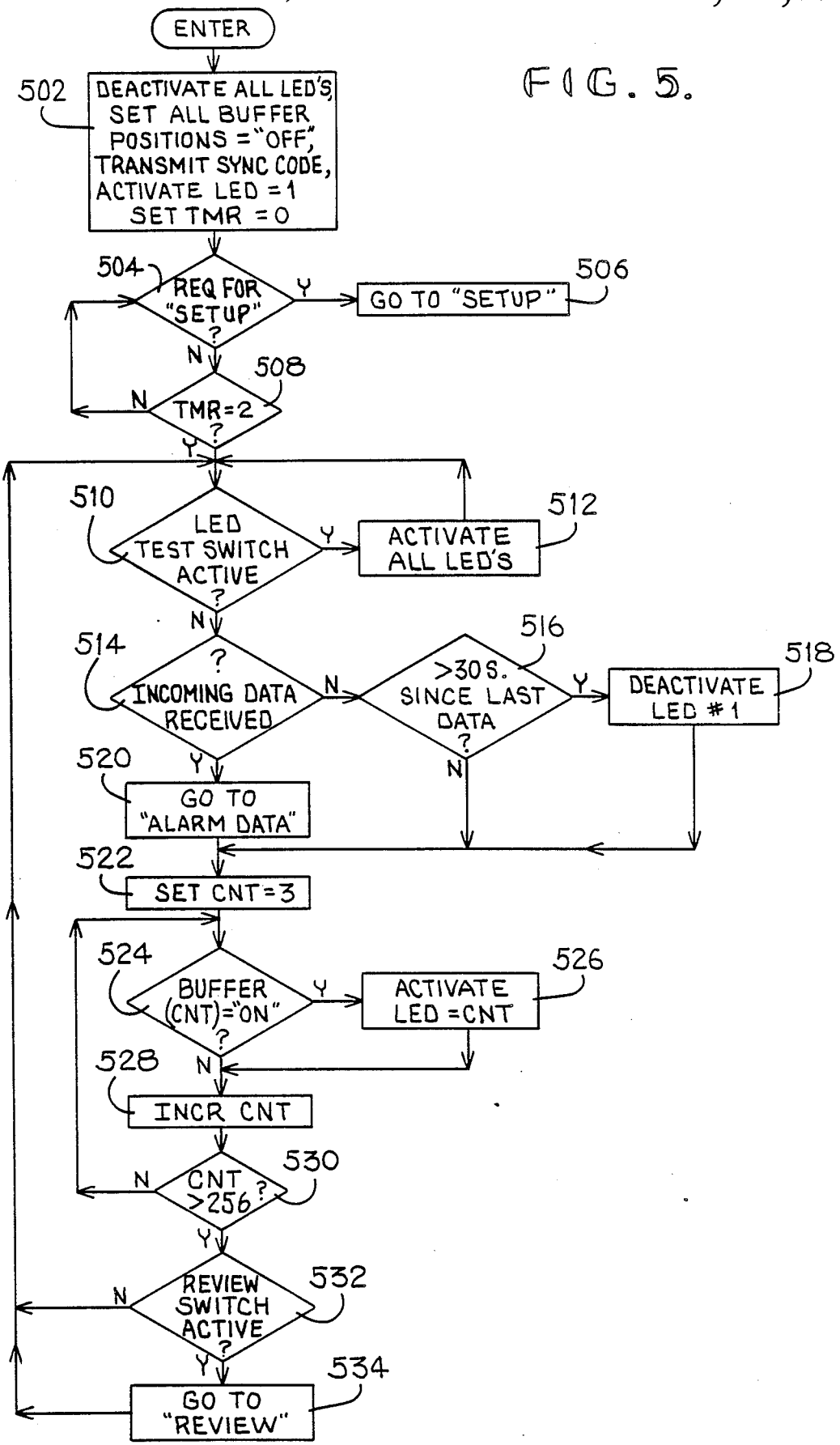
FIG. 5 is a computer program flowchart for operating the annunciator illustrating the MAIN routine.
Figure 6:
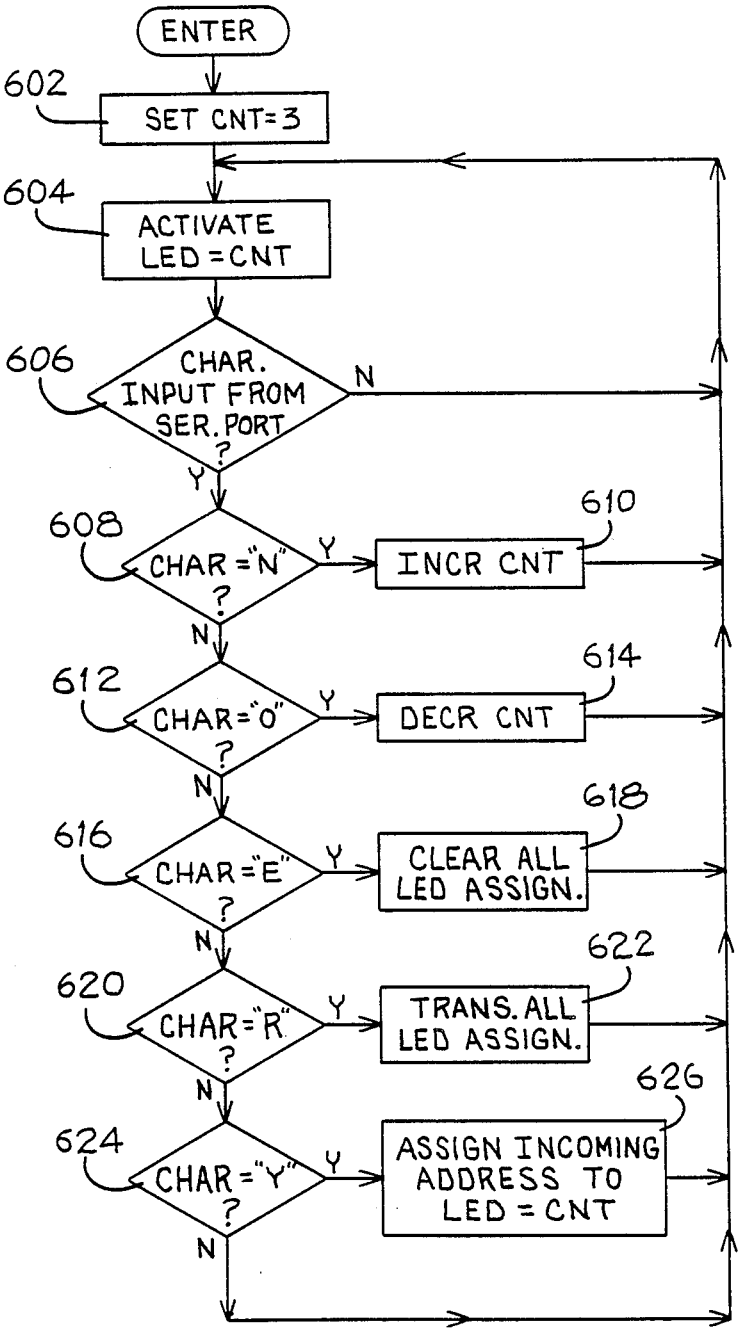
FIG. 6 is a computer program flowchart of the SET UP subroutine of FIG. 5.
Figure 7:
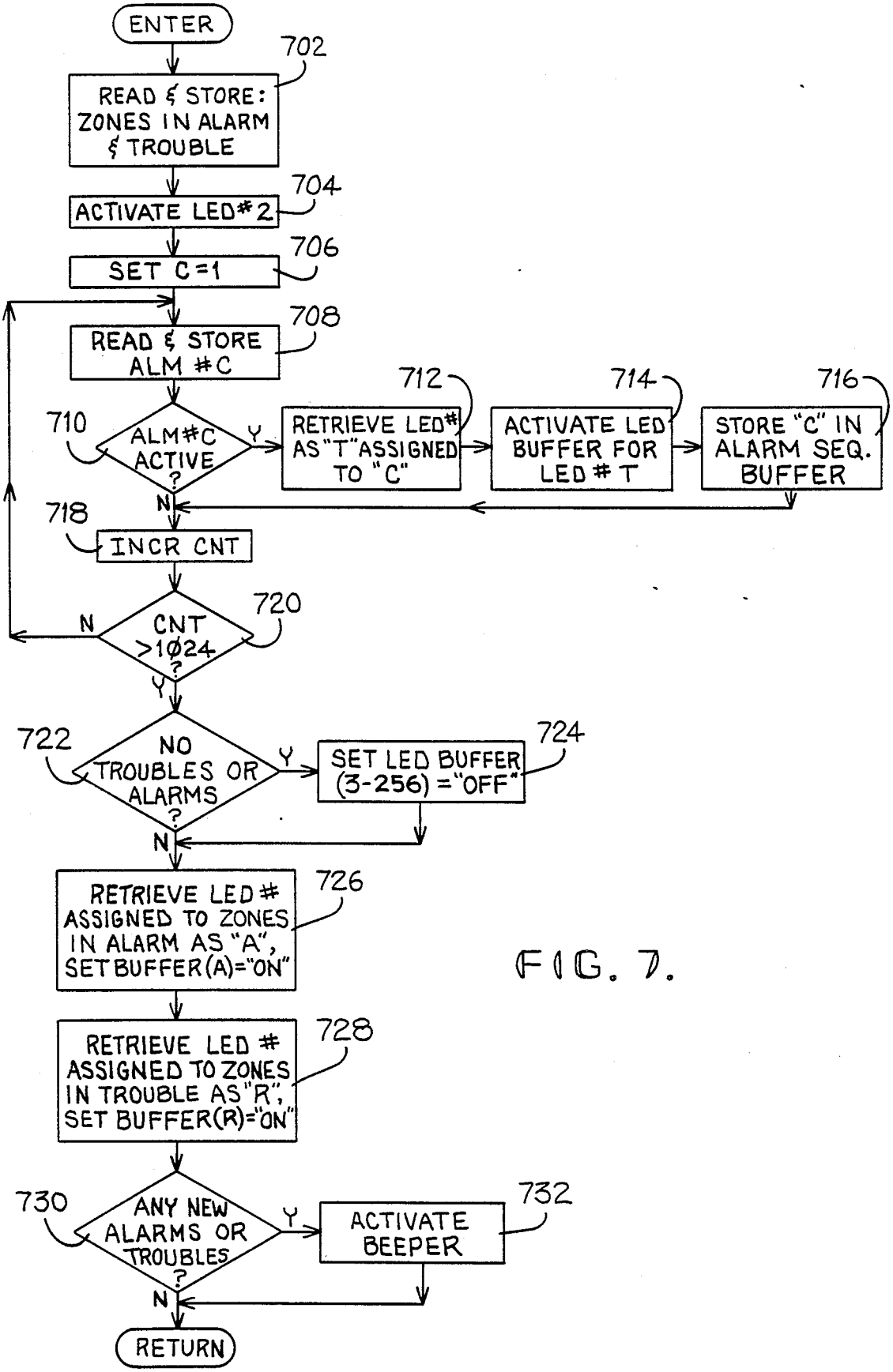
FIG. 7 is a computer program flowchart of the ALARM DATA subroutine of FIG. 5.
Figure 8:
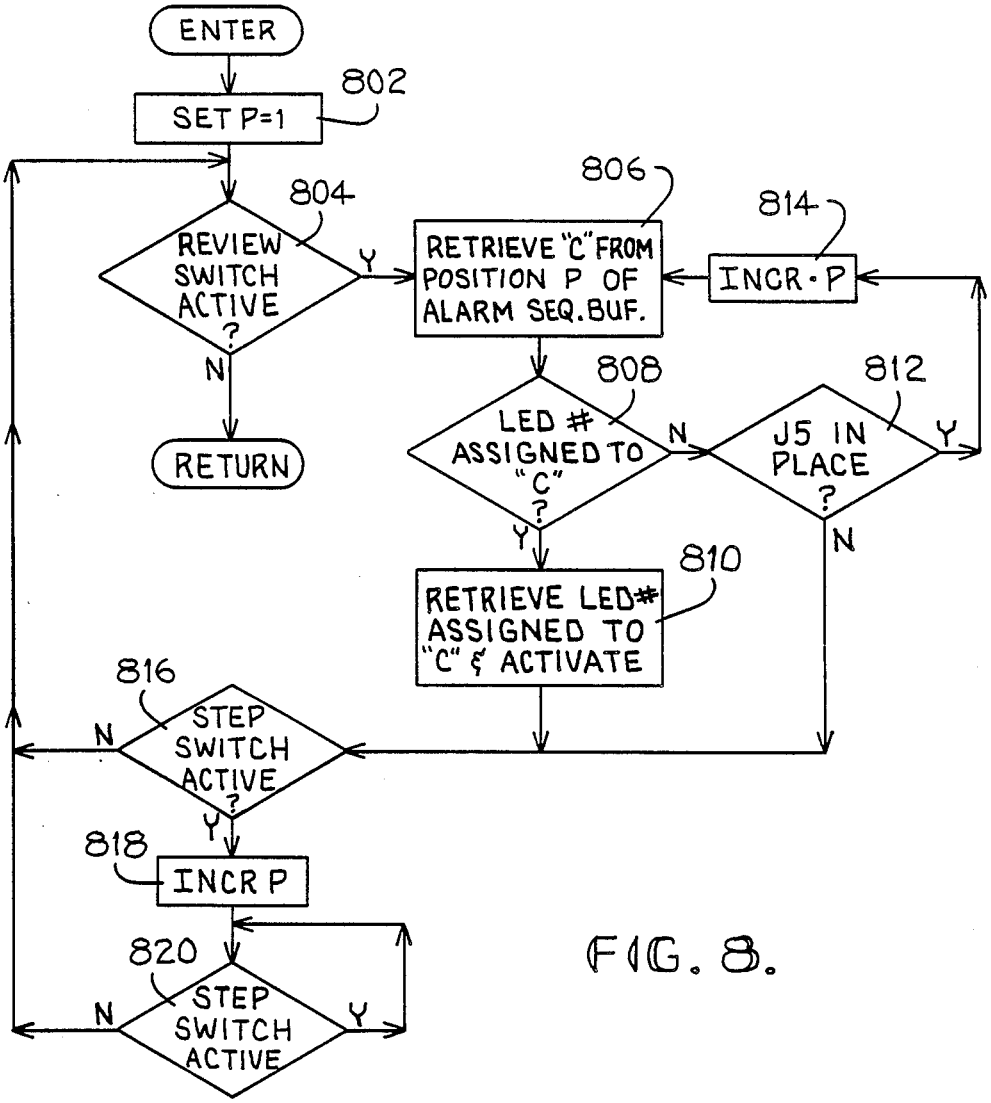
FIG. 8 is a computer program flowchart of the REVIEW subroutine of FIG. 5.

Turning now to the operation of annunciator 10, FIGS. 5–8 are flowcharts illustrating the computer program stored in EPROM 52 for operating annunciator 10. In particular, FIG. 5 illustrates MAIN routine 500 and FIGS. 6–8 illustrate respective subroutines SETUP 600, ALARM DATA 700, and REVIEW 800. With the operating program, signal processing circuit 26 is operable to receive the incoming data signals from detection system 12 and, in response, to actuate certain of indicators 22 in predetermined correspondence with the predetermined conditions indicated by the data signals according to the system configuration stored in NVRAM 54.

The preferred data signals produced by control unit 16 include a verification signal followed by a data stream representative of certain conditions. Control unit periodically transmits the data stream preceded by the verification signal which is preferably a string of A.S.-C.I.I. characters such as a string of "G's". The data stream is preferably sequential bits representative of the zones and detectors in an alarm or trouble condition. As is common in fire protection, some detectors 14 may be arranged in a zone requiring that at least two detectors indicate an abnormal condition such as a fire before that zone is deemed to be in alarm condition and a corresponding bit activated in the data stream. Detection system 12 may also be configured so that an alarm or trouble condition is indicated if a single detector senses an abnormal condition. For example, a small room may have only one fire detector therein, or a single detector indicating an open door or open window may be sufficient to indicate an alarm or trouble condition.

The system configuration stored in NVRAM 54 determines which indicators 22, if any, are to be actuated upon receipt of an active bit in the data stream. That is to say, the configuration data assigns LEDs to certain incoming data bits in order to actuate the assigned LED if that bit is active. The versatility of annunciator 10 is enhanced by allowing an LED to be assigned to more than one incoming data bit.

In the preferred embodiment, LED D1 is assigned as the verification indicator to indicate that communication has been established between annunciator 10 and control unit 16, and LED D2 indicates a zone in an alarm or trouble condition.

NVRAM 54 is bit-mapped to include an incoming alarm buffer having 1024 locations, an alarm sequence buffer having 256 locations, and an LED buffer having 256 locations corresponding to LEDs D1–D256.

On power up of annunciator 10, capacitor C2 (FIG. 3) transmits a reset pulse to microprocessor 46 which initializes the system. The program then enters MAIN routine 500 (FIG. 5) at step 502 which initially deactivates all LEDs by setting all locations in the LED buffer to 0 or "off", and also initializes the alarm data and alarm sequence buffers also to 0. Additionally, step 502 transmits an A.S.C.I.I. synchronization code from microprocessor terminal TXD. If jumper J3 is in place, the synchronization code is transmitted via serial interface 42 and phone jack 44 for reception by a connected terminal. If jumper J4 is in place, the synchronization code is also transmitted by transmitters 38 and 40 for use by a terminal connected to the phone jack of another remotely located annunciator.

Step 502 also activates LED D1 and sets software timer TMR at 0.

The program then moves to step 504 which asks whether a request for SET UP subroutine 600 has been received. Such a request is indicated upon reception of an A.S.C.I.I. character at microprocessor terminal RXD. If such a request has been received, the program moves to step 506 to execute SET UP subroutine 600 which is explained hereinbelow.

If the answer in step 504 is no, the program moves to step 508 which asks whether TMR equals 2 seconds. If not, the program loops through steps 504 and 508 until 2 seconds has elapsed. This allows time for an operator to enter an A.S.C.I.I. character for requesting SET UP subroutine 600.

After 2 seconds, the answer in step 508 is yes and the program moves to step 510 which asks whether LED test switch 96 is active, that is, whether microprocessor terminal P1.6 is logic low. If yes, the program moves to step 512 to activate all LEDs D1–256 as a test.

If the answer in step 510 is no, the program moves to step 514 which asks whether the incoming data is being received. That is to say, step 514 looks at the data signals to see whether the verification signal composed of the string A.S.C.I.I. "G's" is being received. If no, the program moves to step 516 which asks whether it has been greater than 30 seconds since the last verification has been received. If yes, the program moves to step 518 which deactivates LED D1 indicating loss of communication between annunciator 10 and control unit 16.

If the answer in step 514 is yes, the program moves to step 520 to execute ALARM data subroutine 700 which is explained further hereinbelow.

If the answer in step 516 is no, or after steps 518 or 520, the program moves to step 522 to set software counter CNT equal to 3 after which the program moves to step 524 which asks whether the LED buffer location corresponding to CNT is on. Counter CNT is initially set at a value 3 because LED's D1 and D2 are used for other purposes as mentioned above.

If the answer in step 524 is yes, the program moves to step 526 to activate the LED corresponding to the value of CNT. For example, CNT initially equals 3 and if the corresponding LED buffer location is set at 1 or "on", then LED D3 is activated. This is accomplished by activating high anode line A1 which is connected to the anode of LED D3 and by activating low cathode line C3 in order to sink current from anode line A1 through LED D3 to cause light emission thereby.

In order to activate anode line A1, data line D0 goes active high from microprocessor terminal P0.0, microprocessor terminal 1.3 goes active, and microprocessor terminal $\overline{WR}$ goes active low by way of AND 72, NOR 74, to latch 56 in order to latch data D0. The latched data is then sent from terminal Q0 over latch line Q0 from latch 56 to anode driver 82 which causes anode line A1 to go active high to LED D3.

Subsequently, data line D2 goes active from microprocessor terminal P0.2 and microprocessor terminal $\overline{WR}$ and P1.1 go active in order to transmit a strobe signal to terminal STR of cathode sink 60 by way of AND 72 and NOR 78. Cathode line C3 goes active low in response to activate LED D3.

If the answer in step 524 is no, or after step 526, the program moves to step 528 to increment CNT and then moves to step 530 which asks whether CNT is greater than 256. If no, indicating that all of the LED buffer positions have not been polled, the program loops back to step 524.

If the answer in step 530 is yes, the program moves to step 532 which asks whether review switch 92 is active. If no, the program loops back to step 510.

If the answer in step 532 is yes, the program moves to step 534 to execute REVIEW subroutine 800 explained further hereinbelow.

SET UP subroutine 600 (FIG. 6) is used to change the system configuration stored in the upper 4K bytes of NVRAM 54. This can be accomplished locally by plugging a conventional microcomputer into phone jack 44, or remotely over conventional phone lines also plugged into phone jack 44. Execution of SET UP subroutine requires that jumper J3 be in place.

SET UP subroutine 600 enters at step 602 which sets software counter CNT equal to 3. The program then moves to step 604 to activate the LED corresponding to the value of CNT.

The program then moves to step 606 which asks whether an A.S.C.I.I. character has been received at microprocessor terminal RXD by way of phone jack 44 and serial interface 42. If no, the program continues to loop through steps 604 and 606 until a character has been received.

If the answer to step 606 is yes, the program moves to step 608 which asks whether the character is an "N". If yes, the program moves to step 610 to increment CNT.

If the answer in step 608 is no, the program moves to step 612 which asks whether the character is an "0". If yes, the program moves to step 614 to decrement CNT.

If the answer in step 612 is no, the program moves to step 616 which asks whether the character is an "E". If yes, the program moves to step 618 to clear all LED assignments in the system configuration.

If the answer in step 616 is no, the program moves to step 620 which asks whether the character is an "R". If yes, the program moves to step 622 which transmits all of the LED assignments.

If the answer in step 620 is no, the program moves to step 624 which asks whether the character is a "Y". If yes, step 626 then assigns the LED location in the LED buffer corresponding to the value of CNT equal to the address received. That is to say, after entering character "Y", the operator enters the desired data bit address for activating the LED corresponding to the value of CNT.

If the answer in step 624 is no, or after steps 610, 614, 618, 622 or 626, the program loops back to step 604. The program can exit SET UP subroutine 600 by resetting microcomputer 46 by turning the power off and then on again.

ALARM DATA subroutine 700 (FIG. 7) is normally executed once through each loop of MAIN routine 500 after step 514 thereof.

The program enters subroutine 700 after receiving the verification signal which precedes the data stream at step 702 which first reads and stores the initial data corresponding to zones in alarm and trouble. That is to say, it is preferred that control unit 16 initially send data bits corresponding to zones which are alarm or trouble. This information is read and stored in the alarm data buffer. The program then moves to step 703 which activates LED D2 indicating that alarm data has been received.

The program then moves to step 706 which sets counter C equal to 1 and then to step 708 which reads and stores the alarm bit corresponding to counter "C". This alarm information corresponds to an individual detector in ALARM in contrast to the zone alarms and to troubles read and stored in step 702.

The program then moves to step 710 which asks whether the data bit or alarm corresponding to "C" is active. If yes, the program retrieves from a system configuration the LED number as variable "T" assigned to alarm data bit "C".

The program then moves to step 714 to activate position "T" in the LED buffer. For example, LED D98 may be assigned to alarm data bit 7, which if active, would cause LED D98 to be actuated.

The program then moves to step 716 to store a value corresponding to "C" in the ALARM sequence buffer.

If the answer in step 710 is no, or after step 716, the program moves to step 718 to increment "C" and then moves to step 720 which asks whether "C" exceeds 1024 which is the preferred maximum number of active alarms or troubles transmitted from control unit 16. If no, the program loops back to step 708 to again store the next data bit received over transmission line 18.

If the answer in step 720 is yes, the program moves to step 722 which asks whether no alarms or troubles have been indicated in steps 708–720. If yes, the program moves to step 724 to set LED buffer locations 3 through 256 low or "off".

If the answer in step 722 is no, or after step 724, the program moves to step 726 to retrieve from the system configuration the LED numbers assigned to the zones as read and stored in step 702. Step 728 retrieves the LED assignment number as variable "A" and sets the corresponding LED buffer location active.

The program then moves to step 728 to retrieve the LED numbers assigned to those zones indicated as being a trouble condition as read and stored in step 702. These LED numbers are retrieved from the system configuration as variable "R" and the corresponding LED buffer location activated.

The program then moves to step 730 which asks whether any of the alarms or troubles as determined in steps 702–728 are new since the last pass. If yes, the program moves to step 732 to activate beeper 112 by activating microprocessor P1.7 low which clears flip-flop 110 so that flip-flop terminal Q goes low to sink current from Vcc through beeper 112. If the answer in step 730 is no, or after step 726, the program returns to MAIN routine 500 at step 522.

REVIEW subroutine 800 (FIG. 8) allows manual actuation of annunciator 10 in order to view the sequential progression of alarm and trouble conditions. This can be very useful, for example, in diagnosing the origin of a fire, its spread, and extinguishment in the protected area, or to view the progress of intrusions through doors and windows. Activation of review switch 92 causes the program to enter subroutine 800 and activation of step switch 94 causes the next sequential alarm stored in the alarm sequence buffer to be displayed.

The program enters REVIEW subroutine 800 (FIG. 8) after step 532 in MAIN routine 500 if review switch 92 is active, that is, if microprocessor terminal P1.4 is active low. The program enters at step 802 which sets software variable P equal to 1.

The program then moves to step 804 which asks whether review switch 92 is still active. If no, the program returns to step 510 of MAIN 500. This requires review switch 92 be continually depressed during the review function to ensure return to normal operation. If yes, the program moves to step 806 to retrieve alarm "C" from the alarm sequence buffer at the position corresponding to the value of variable "P". Active alarms are stored in sequence in step 716 of ALARM DATA subroutine 700.

As an example, with P equal to 1, the first alarm "C" stored in the alarm sequence buffer is retrieved. This also corresponds to the oldest alarm in the buffer.

The program then moves to step 808 which asks the whether the system configuration has assigned an LED number to alarm "C" retrieved in step 806. It may be, for example, that it is desired not to actuate an LED for all alarm or trouble occurrences. Accordingly, step 808 determines whether an assignment is defined in the system configuration stored in NVRAM 54.

If yes, the program moves to step 810 to retrieve the LED number assigned to alarm "C" and to activate that LED.

If the answer in step 808 is no, the program moves to step 812 which asks whether jumper J5 is in place, that is, whether microprocessor terminal INT0 is active low. With this jumper in place, the program will loop through unassigned alarms without requiring activation of step switch 94. If the answer in step 812 is yes, the program moves to step 814 to increment variable P and then loops back to step 806.

If the answer in step 812 is no, or after step 810, the program moves to step 816 which asks whether step switch 94 is active, that is, whether microprocessor terminal P1.5 is active low. If no, the program loops back to step 804. If yes, the program moves to step 818 to increment variable P.

The program then moves to step 820 which asks whether the step switch 94 is active. If yes, the program continues to loop through step 820 until step switch 94 is released after which the program loops back to step 804. In the preferred embodiment, REVIEW subroutine 800 continues until review switch 92 is released.

As discussed above, the versatility of annunciator 10 is enhanced by the provision of transmitters 38 and 40. As illustrated in FIG. 1, this allows virtually any desired number of annunciators to be placed in operation in locations such as each floor of a building or each store in a shopping mall. The versatility of annunciator 10 is further enhanced by the ability to configure the LED assignments for each annunciator. This allows, for example, annunciator A1 (FIG. 1) to be a master annunciator graphically illustrating all alarm locations and allows the other annunciators to be custom configured only for the local area associated with that annunciator.

The preferred structure of annunciator 10 also allows it to be combined with other annunciators to form a larger unitary annunciator. This may be desirable, for example, when detector system 12 has more alarm configurations than the maximum number of indicators 22 available on a single annunciator 10. For example, if it is desired to provide a graphic annunciator with 500 indicators 22, two annunciators 10 can be placed side-by-side with their two front panels 20 combined to present a single large graphic representation of the protected area. Each of the two annunciators is configured to annunciate a respective 250 alarm conditions to provide the total required. The second annunciator receives the data signals as retransmitted through one of transmitters 38 or 40 from the first annunciator. Additionally, in the second annunciator, the microprocessor terminals P1.4, P1.5, and P1.6 can be respectively connected to terminals 102, 104, and 106 in the first annunciator, and terminal PR 110 in the second annunciator can be connected to terminal 108 of the first annunciator. This allows a single set of switches 9214 98 present in the first annunciator to control both annunciators. Additional annunciators can also be added in this cascade arrangement as needed to provide the desired number of actuatable indicators 22.

As those skilled in the art will appreciate, the present invention contemplates many variations in the preferred embodiment herein described. For example, annunciator 10 can be used to visually indicate predetermined conditions in addition to fire and unauthorized entry as herein described such as temperatures, flows, active and inactive devices in a chemical processing plant. Additionally, while the desired logic functions of annunciator 10 are preferably performed by a microprocessor with associated operating program, these same functions could be performed by hardware alone by use of a custom designed semi-conductor chip, for example. As a final example, annunciator 10 can be configured to receive data signals in other formats such as analog or parallel data instead of the preferred optical digital signals in serial format.

Having thus described the preferred embodiment of the present invention, the following is claimed as new and desired to be secured by Letters Patent:

1. An annunciator for use with a detection system operable for producing detection signals representative of certain predetermined conditions, said annunciator comprising:

a plurality of selectively activatable indicators; and signal processing means, including a plurality of output connections coupled with said indicators, for receiving said detection signals and responsive thereto for activating selected ones of said indicators, said processing means including means for storing condition data representative of said predetermined conditions in response to receipt of said signals, means for receiving and storing assignment data representative of selected assignments of said indicators to selected ones of said conditions, and means responsive to said condition and assignment data for activating said indicators in accordance therewith.

2. The annunciator as set forth in claim 1, the data signals including optical data signals, and further including a fiber optic cable for operably intercoupling said receiving means with the detection system for transmission of said optical data signals thereover.

3. The annunciator as set forth in claim 1, said signal processing means including a microprocessor.

4. The annunciator as set forth in claim 1, said indicators including light-emitting diodes.

5. The annunciator as set forth in claim 1, the predetermined conditions being associated with a protected area, said annunciator further including means presenting said indicators in a graphic representation of the protected area.

6. The annunciator as set forth in claim 1, said data signals including periodically transmitted verification signals, said signal processing means including verification means for actuating selected ones of said indicators upon failure to receive said verification signals within a predetermined time limit.

7. The annunciator as set forth in claim 1, further including optical signal producing means for coupling with the detection system and for producing said data signals as optical data signals, said signal processing means including optical signal receiving means for receiving said optical data signals, said annunciator further including fiber optic means for intercoupling said optical signal producing means and said optical signal receiving means for transmission of said optical signals therebetween.

8. An annunciator as set forth in claim 1, said predetermined condition including alarm conditions concerning an area protected by the detection system.

9. The annunciator as set forth in claim 1, further including data entry means for entering said assignment data into said receiving and storing means on the site of said annunciator.

10. The annunciator as set forth in claim 1, further including remote data entry means for entering said assignment data into said receiving and storing means from a location remote from said annunciator.

11. An annunciator for use with a detection system operable for producing detection signals representative of certain predetermined conditions, said annunciator comprising:

a plurality of selectively activatable indicators; and signal processing means operably coupled with said indicators for receiving said detection signals and responsive thereto for selectively activating said indicators, said signal processing means including means responsive to receipt of said detection signals for storing history data representative of sequential occurrences of said predetermined occurrences, and selectively activatable means responsive to said history data for selectively and successively activating said indicators in sequential correspondence with said occurrences for providing a sequential review thereof.

12. The annunciator as set forth in claim 11, said activatable means including means for manual activation thereof.

13. The annunciator as set forth in claim 11, said signal processing means including a microprocessor.

14. The annunciator as set forth in claim 11, said indicators including light-emitting diodes.

15. The annunciator as set forth in claim 11, the predetermined conditions being associated with a protected area, said annunciator further including means presenting said indicators in a graphic representation of the protected area.

16. The annunciator as set forth in claim 11, said data signals including periodically transmitted verification signals, said signal processing means including verification means for actuating said ones of said indicators upon failure to receive said verification signals within a predetermined time limit.

17. A method annunciating certain predetermined conditions as represented by detection signals produced by a detection system operable for detecting said conditions and for producing said detection signals in response, said method comprising the steps of:

providing a plurality of indicators:

providing a signal processing means, including a plurality of outputs, for receiving the detector signals and responsive thereto for selectably activating said outputs;

connecting said outputs with said indicators;

storing condition data representative of said predetermined conditions in response to receipt of said detection signals in memory means operably associated with said processing means;

subsequent to said connecting step, storing assignment data representative of selected assignments of said indicators to selected ones of said conditions in memory means operably associated with said processing means; and activating said indicators in accordance with said assignment and condition data.

18. The method as set forth in claim 17, said connecting step including step of connecting said output with said indicators during manufacture of said annunciator.

19. The method as set forth in claim 17, further including the step of installing said annunciator on a site prior to said step of storing assignment data.

20. An annunciator for use with a detection system operable to produce data signals representative of certain predetermined conditions, said annunciator comprising:

a plurality of selectively actuable indicators;

signal processing means coupled with said indicators including means for coupling with the detection system for receiving and processing said data signals and in response thereto for actuating selected ones of said indicators in predetermined correspondence with predetermined conditions, said data signals being optical data signals, said signal processing means including optical signal receiving means for receiving said optical data signals, retransmission means for coupling with a transmission line and for receiving and retransmitting said data signals thereover, selectively alterable memory means for storing configuration data representative of said predetermined correspondence and for selectively actuating said indicators in response to said configuration data and data signals, and for storing history data representative of a plurality of sequential occurrences of said predetermined conditions, and means coupled with said memory means and responsive to said history data for selectively and successively actuating certain ones of said indicators in sequential correspondence with said occurrences in order to provide a sequential review thereof, said indicators being activatable upon simultaneous receipt of two activation signals, said signal processing means further including a plurality of indicator outputs for selectively producing respective activation signals, and means coupling said outputs and indicators in a multiplex arrangement with each indicator being coupled with two of said outputs for receipt of respective activation signals therefrom upon actuation of said respective indicators.

* * * * *